US005667153A

United States Patent [19]

Haack et al.

[11] Patent Number: 5,667,153

[45] Date of Patent: Sep. 16, 1997

[54] PRESSURE AND FEED SCREW FOR MEAT GRINDERS

[75] Inventors: Eberhard Haack, Halle; Michael Mössmer, Betzweilerwälde, both of Germany

[73] Assignee: Maschinenfabrik Dornhan, Dornhan, Germany

[21] Appl. No.: 364,441

[22] Filed: Dec. 27, 1994

[51] Int. Cl.[6] ..... B02C 18/38

[52] U.S. Cl. ..... 241/82.5; 241/260.1

[58] Field of Search ..... 241/82.1–82.7, 241/DIG. 30, 260.1

[56] References Cited

U.S. PATENT DOCUMENTS

| | | | |
|---|---|---|---|
| 1,330,775 | 2/1920 | Anderson | 241/82.5 |
| 1,835,864 | 12/1931 | Gumprich | 241/82.5 |
| 3,081,806 | 3/1963 | Oatley | 241/82.5 |
| 3,376,910 | 4/1968 | Popeil | 241/82.5 |
| 4,304,054 | 12/1981 | Nauck | 241/82.5 |

*Primary Examiner*—Mark Rosenbaum
*Attorney, Agent, or Firm*—Karl Hormann

[57] ABSTRACT

A dual component pressure and feed screw of the kind useful in food processing machines, such as meat grinders, including a drive shaft and a screw component removably mounted thereon, the shaft and screw being preferably made of steel and a polymeric material, respectively, the shaft being provided with an integrally formed extension for receiving a cutter assembly.

17 Claims, 3 Drawing Sheets

PRESSURE AND FEED SCREW FOR MEAT GRINDERS

BACKGROUND OF THE INVENTION

1. Field of the Invention

The invention, in general, relates to food processing machinery and, more particularly, to novel pressure and feed screws of the kind useful for meat grinders and the like.

2. Statement of the Prior Art

It is commonly known that pressure and feed screws in meat grinders serve the dual function of advancing the raw materials, e.g., meat and the like, through the screw barrel or pressure chamber of the meat grinders, and of driving the rotary cutting knives. Therefore, not only must the back pressure be overcome which acts on the screw, through the meat, as a reverse head pressure from the non-rotating cutter discs, but, at the same time, the rotary cutting knives must also be driven to cut or grind the meat protruding into the discs.

These two functions have heretofore been performed by pressure and feed screws which are either mechanically unitary structures including the drive shaft for driving the rotary cutting knives, or have a separately driven center shaft extending through an axial bore in the screw for driving only the rotary knives.

The power required for these functions rises disproportionately, and at present only the so-called Enterprice cutters are operating on this principle. However, no substantial advantages have been obtained from the high power requirements.

To improve the function of feeding the material to be ground feed screws have been modified by providing flights of variable pitches and/or reverse-feed blocking arrangements in the flanks of the screw flights. Such arrangements are known from (East) German Patents DD-286,117 and DD-286,118.

A variable pitch in a screw flight may be obtained by screws composed of separate sections with individually different uniform or variable flight pitches and fixedly mounted on a common drive shaft.

Known pressure and feed screws of the kind under consideration have been wholly made of steel, cast steel, or cast iron alloys. Hence, their manufacturing costs in terms of labor and materials from which they are made are high.

OBJECTS OF THE INVENTION

It is an object of the invention to provide a pressure and feed screw of the kind useful in meat grinders which satisfies requisite through-feed and cutting conditions.

Another object of the invention is to provide an easily replaceable or exchangeable pressure and feed screw.

Still another object of the invention is to provide a pressure and feed screw which substantially avoids the abrasion of material particles from the screw barrel.

It is also an object of the invention to provide a pressure and feed screw made of inexpensive materials by relatively simple manufacturing operations.

It is a further object of the invention to provide a pressure and feed screw made from polymeric materials satisfying the high hygienic demands prevalent in the food processing industry.

SUMMARY OF THE INVENTION

In accordance with these and other objects, the invention, in a preferred embodiment thereof, provides for a pressure and feed screw comprising a drive shaft and a screw component connectable thereto, the shaft being provided with an extension for receiving a cutter assembly, the screw component being positioned on the drive shaft such that the final one or zero point of the screw flight is located in a predetermined orientation relative to the initial cutting blade.

By way of further advantage the screw may be made of a polymeric material approved for food processing.

Preferably, the screw and the drive shaft are maintained in their relative positions by complementary engagement surfaces.

In a particularly advantageous embodiment of the invention the screw is removably mounted on the drive shaft.

The various features of novelty which characterize the invention are pointed out with particularity in the claims annexed to and forming part of the disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

The invention will be explained in greater detail hereafter with reference to embodiments shown in the accompanying drawings, in which.

DETAILED DESCRIPTION OF THE PREFERRED EMBODIMENTS

While the pressure and feed screw will hereinafter be described in connection with a meat grinder, it is to be understood by those skilled in the art that utilization may be equally appropriate in other food processing equipment.

Figure 1:
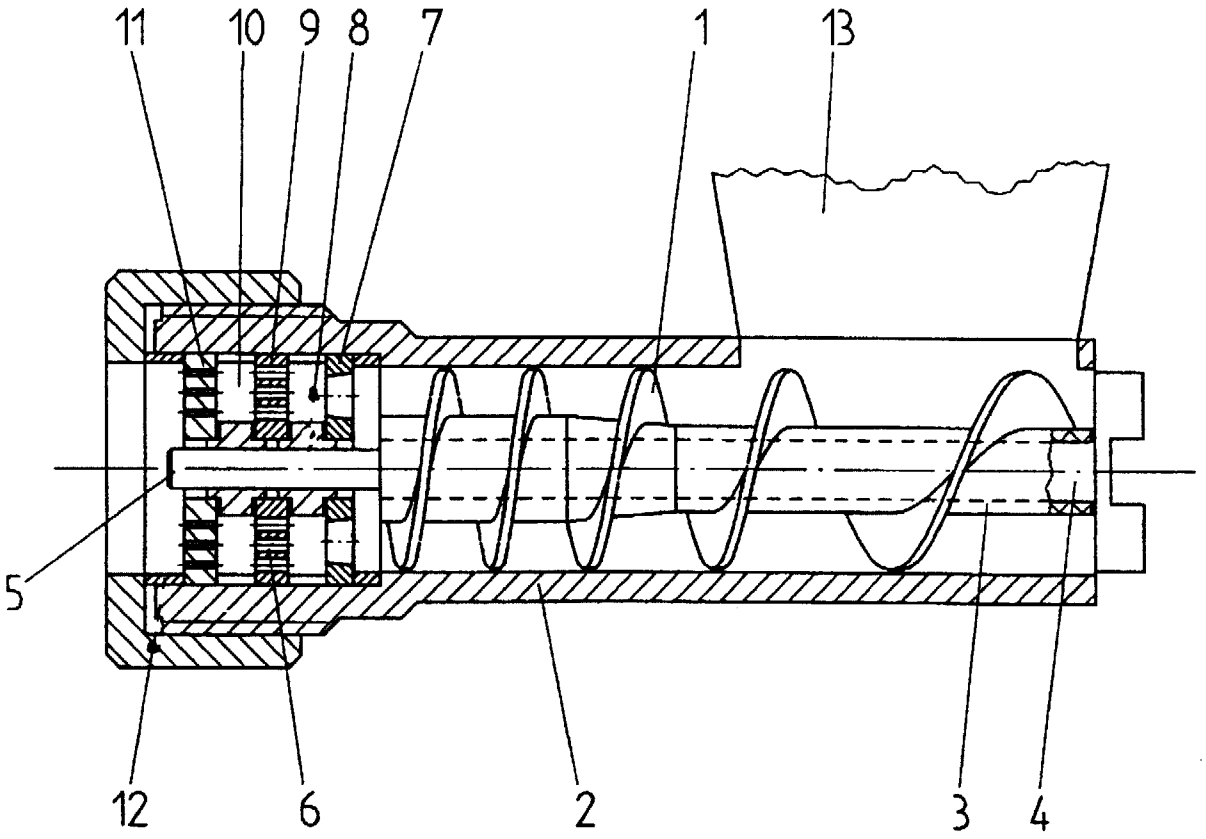
FIG. 1 is a schematic representation of a meat grinder.

A pressure and feed screw 1 as shown in FIG. 1, is mounted in a screw barrel 2 of a meat grinder in a conventional manner. The body 3 of the screw 1 is mounted on and fixedly connected to a steel drive shaft 4. An extension or pin 5 is provided at one end of the drive shaft 4. The pin 5 may be affixed to the shaft 4 or it may be machined as an integral part thereof, and is adapted to receive a cutter assembly 6.

FIG. 1 is a schematic overall presentation and depicts the arrangement or position of the pressure and feed screw 1 within the screw barrel 2 of a meat grinder.

For journalling the pressure and feed screw 1 at its end facing the drive means, such as, for instance, an electric motor (not shown), there is provided within the adjacent end of the grinder housing or screw barrel 2 a bearing (not shown). At the discharge end of the schematically depicted meat grinder the screw 1 is journalled or supported within the barrel 2 by the cutter arrangement 6, usually within a central bore of one or all of the perforated disks of the cutter assembly.

As shown, the cutter assembly 6 comprises five components, including a precutter 7, a rotary knife 8, a perforated disc 9, another rotary knife 10 and a final or terminal perforated disc 11. The parts of the cutter are connected to the barrel 2 by a spacer bushing and a sleeve nut or threaded flange 12.

As may further be seen, the body 3 of the pressure and feed screw 1 is provided with a variable pitch flight which at the intake section of the screw barrel 2, i.e., below a hopper or intake opening 13, is greater and is progressively reduced in the direction of the cutter assembly 6. This configuration has been found to have a positive effect upon pressure build-up and material feed.

Figure 2:
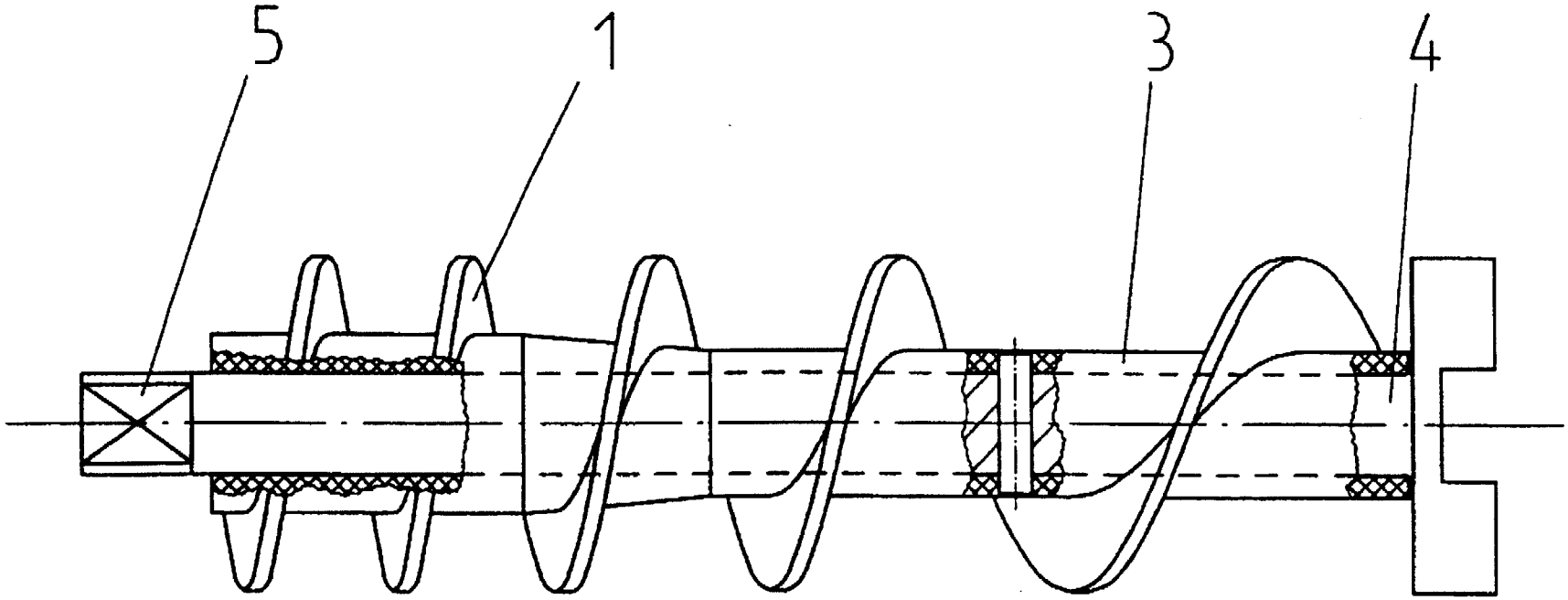
FIG. 2 depicts a pressure and feed screw in accordance with the invention for use in an apparatus as shown in FIG. 1.

A more detailed presentation of the screw 1 is shown in FIG. 2. As may be seen, the screw 1 comprises two components, i.e. screw body 3 per se and steel drive shaft 4.

The drive shaft 4 is provided with an integral extension or pin 5 for mounting the cutter assembly 6 thereon.

The connection of the screw body 3 to the steel shaft 4 may be accomplished in various known ways, a releasable pintle or bolt connection being at present preferred for ensuring, on the one hand, a safe connection and, on the other, the possibility of a quick and easy removal or replacement of the screw body 3. Complementary engagement or keying surfaces in the screw 1 and the drive shaft 4 may be utilized instead or in addition to the bolt connection, and further, means such as nuts, may be provided for releasably securing the screw and the drive shaft against relative axial displacement.

A releasable connection is considered to be an important advantage of the invention, since by rendering the screw body 3 easily removable or replaceable, feeding and processing operations are attained which yield results of superior quality, by matching the screw body with the particular kind and condition of the material to be processed.

Materials to be processed may range from frozen meat having a core temperature of about −20° C. (4° F.) to boiled sausage meat at temperatures of about +80° C. (+176° F.), so that the screw 1 in accordance with the invention may be subjected to temperatures differing by as much as 100° C. (180° F.). Such raw materials require different individual treatment or processing, especially in the feed zone of the screw barrel 2 leading to the cutter assembly 6, to ensure a high quality processing operation.

As will be apparent to those skilled in the art, the screw in accordance with the invention may also, for purposes specific to a desired product, be advantageously used for processing fresh meat at temperatures ranging from 10° to 20° C. (50° to 68° F.).

Figure 3:
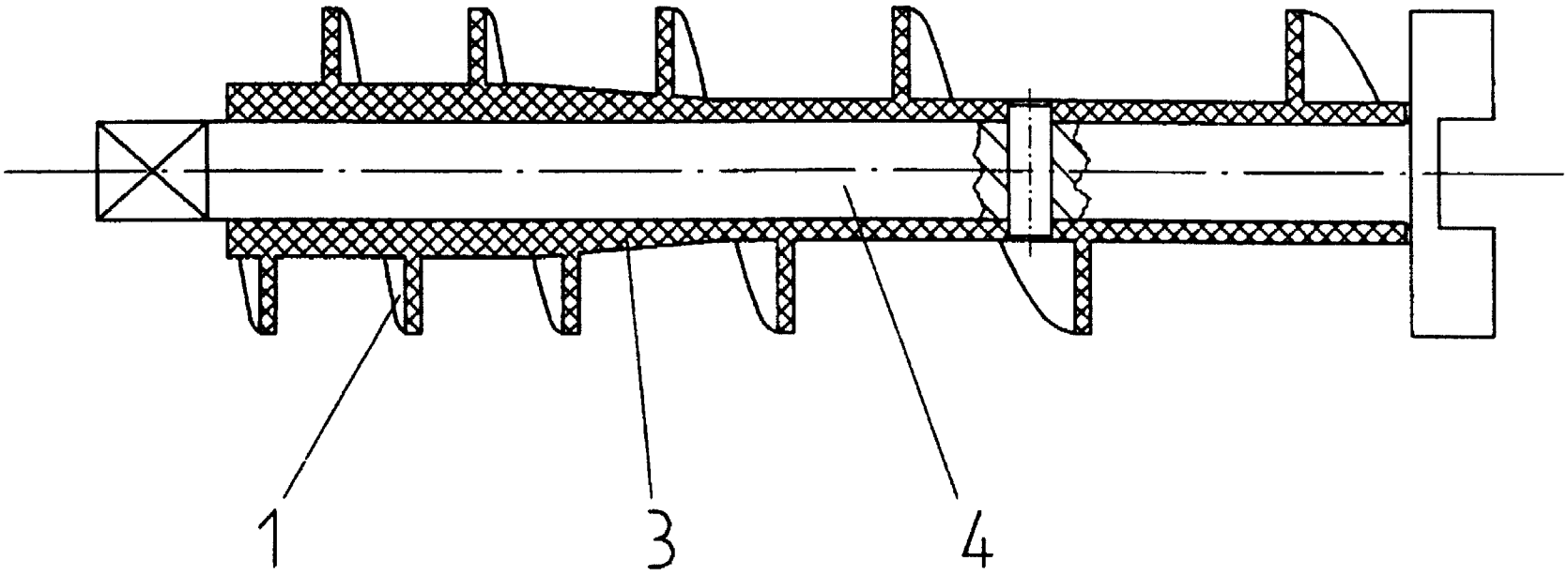
FIG. 3 is a partial longitudinal section of the feed screw of FIG. 2.

The pressure and feed screw body 3 has been depicted in partial longitudinal section in FIG. 3.

It has been found that 10–30% of the force applied to a meat grinder is consumed for advancing the meat to be ground; the remaining force is used up for the cutting or grinding of the meat by the cutter assembly. For this reason, the screw 1 comprises two components, i.e. a high-tensile shaft, such as, preferably, a steel shaft with a milled-in keying surface for the cutter drive, and a hollow screw body mounted on the steel shaft.

The body 3 of the screw 1 is preferably made of a polymeric material, such as polyethylene, synthetic rubber, and the like, with or without reinforcement by fiberglass, or of polymer saturated ceramic materials. The screw body may be coated with friction reducing substances, such as polytetrafluoroethylene. Preferably, the screw is made from man-made materials which are abrasion-resistant, and which have low coefficients of friction. The screw body may be manufactured by milling operations, or, to greater economic advantage, by injection molding.

The shaft and the screw body are form-fittingly connected to each other to allow a quick exchanges or replacements of screw bodies to accommodate given process conditions and to assure its positioning relative to the cutter assembly. In addition, such a structure is to satisfy high hygienic standards; and repairs are made easy.

For an operation, the body 3 of the pressure and feed screw 1 is first mounted and affixed to the steel shaft 4, as described supra. Once assembled, it is inserted into the screw barrel 2 of the meat grinder. The meat to be processed is fed through the intake or hopper 13 into the barrel 2 from where it is advanced into the cutter arrangement 6 by the screw 3 when it is rotated in the appropriate direction, and it is then cut or ground by the interaction between the cutter blades and their associated perforated disc before it is pushed through the perforations in the discs and out of the barrel 2.

Since the body 3 of the screw 1 is connected to the steel shaft 4 only, and the components of the cutter assembly are attached to the pin 5 of the shaft 4, the sole function of the screw body 3 is to feed the material and to build up pressure. Hence, the screw does not transmit any force to the cutter assembly, this being now a function of the drive shaft. That is to say, the torsional forces acting on the rotary cutter assembly 6 are separated from those acting on the pressure and feed screw 1. This, in turn, has a favorable effect on the size of the screw body 3.

Any abrasion of metallic particles from the screw barrel 2 or, indeed, from the screw itself is avoided, and cannot, therefore, contaminate the meat being processed.

By arranging and mounting the cutter assembly 6 on the pin 5 of the shaft 4, the components of the cutter are effectively supported and driven by the steel shaft 4 rather than by the screw body 3, and their alignment with respect to the pressure and feed screw 3 is assured as well.

Positioning of the pressure and feed screw body 3 relative to the cutter assembly 6 and, hence, its arresting on the steel drive shaft 4 are such that the highest or zero point of the final screw flight relative to the precutter/knife 7, 8 located forwardly of it, lends some support to the discharging meat while at the same time they ensure unimpeded discharge from the screw 1.

The two-component pressure and feed screw has been designed in view of the fact that only about 10–30% of the power input to a meat grinder is used to feed the material to be processed, the remaining power being used for cutting the material in the cutter assembly. The shaft is made of a high-strength material, preferably steel, and is provided with a dual surface or other suitably configured surface arrangement for engagement with the cutter assembly. The pressure and feed screw body 3 is provided with an appropriately configured axial bore for receiving the drive shaft 4.

The pressure and feed screw is made of a high-impact high-polymer material, such as high-pressure polyethylene, which is sufficiently rugged to withstand the forces to which it is subjected during operation of the apparatus and which lends itself to being easily cleaned. The screw 1 is slidably moveable within the chamber 2.

The two components are operatively connected to each other in such a manner that the screw body 3 may easily be exchanged or replaced to suit particular operational requirements, and that it may be affixed relative to the cutter assembly a in predetermined orientation. Because of its easy removability from the screw barrel 2, the screw 1 provides for ease of cleaning and repairing of the apparatus.

Accordingly, the present invention does provide a pressure and feed screw of the kind useful in food processing machinery which can easily be exchanged or replaced, which prevents contamination by metal shavings, which can be manufactured by simpler methods and more economically than screws currently in use.

It will be obvious to those skilled in the art that many modifications may be made within the scope of the present invention and without departing from the scope of the invention disclosed, which has been defined in the appended claims.

What is claimed is:

1. For use in a meat grinding apparatus of the kind comprising elongate barrel means of substantially circular cross-section and predetermined length and provided adjacent at least one of its ends with an axially disposed rotary bearing means and rotary cutter means and with feed hopper means adjacent its other end, a pressure and feed screw means adapted to be rotatably received in said barrel means, said screw means comprising:

elongate body means of substantially cylindrical configuration provided with a bore extending substantially coaxially therethrough and comprising screw flight means integral with and uninterruptedly extending over said elongate body means in a substantially helical configuration of variable pitch;

elongate drive shaft means rotatably journalled in said bearing means and extending through said bore and being releasably affixed to said screw means and said rotary cutter means, thereby separating torsional forces acting on said screw means and on said rotary cutter means.

2. The screw of claim 1, wherein said bore and said drive shaft means are provided with complementarily configured engagement means for maintaining the angular disposition of said elongate body means relative to said drive shaft means.

3. The screw of claim 2, including means for releasably connecting said elongate body means to said drive shaft means.

4. The screw of claim 2, wherein said drive shaft means is provided with an integral extension adapted to be operatively connected to said cutter means.

5. The screw of claim 4, wherein the flight portion adjacent to the cutter means is positioned in a predetermined relation thereto.

6. The screw of claim 1, wherein said elongate body means and said drive shaft means are connected to each other by a bolt extending radially therethrough.

7. The screw of claim 1, wherein said drive shaft means is made of steel.

8. The screw of claim 1, wherein said elongate body means is made of polymeric material.

9. The screw of claim 8, wherein said polymeric material is polyethylene.

10. The screw of claim 9, wherein said polyethylene is reinforced by fiberglass.

11. The screw of claim 9, wherein said polyethylene is reinforced by a ceramic material.

12. The screw of claim 9, including an exterior coating of a friction reducing agent.

13. The screw of claim 11, wherein said friction reducing agent is polytetrafluoroethylene.

14. The screw of claim 1, wherein said elongate body means comprises a plurality of axially aligned sections.

15. The screw of claim 13, wherein the screw flight of each section is uniform but different from every other section.

16. The screw of claim 14, wherein each section is provided with a screw flight of variable pitch.

17. The screw of claim 1, wherein said elongate body has an intake end adjacent to said feed hopper and a discharge end adjacent to said cutter means and wherein the pitch of the screw flight is reduced from said intake to said discharge end.

* * * * *